United States Patent [19]

White, Sr.

[11] Patent Number: 4,827,841

[45] Date of Patent: May 9, 1989

[54] TICKET ISSUING MACHINE

[75] Inventor: Gorman W. White, Sr., Baltimore, Md.

[73] Assignee: Consolidated Engineering and Manufacturing Corp., Forest Hill, Md.

[21] Appl. No.: 718,496

[22] Filed: Apr. 1, 1985

[51] Int. Cl.[4] ..... B41J 11/48

[52] U.S. Cl. ..... 101/66; 400/605

[58] Field of Search ..... 221/133; 101/66; 226/49, 110; 400/605

[56] References Cited

U.S. PATENT DOCUMENTS

| | | | |
|---|---|---|---|
| 3,694,620 | 9/1972 | Gleason | 226/110 X |
| 3,753,560 | 8/1973 | Kapral et al. | 271/9 |
| 3,850,356 | 11/1974 | Abe et al. | 226/110 |
| 3,861,303 | 1/1975 | Dorn, Jr. | 101/227 |
| 3,931,761 | 1/1976 | Carrus et al. | 101/66 |
| 3,936,042 | 2/1976 | Smith et al. | 271/9 |
| 4,134,691 | 1/1979 | Matschke | 400/124 |
| 4,216,719 | 8/1980 | Flaceliere et al. | 226/49 X |
| 4,218,149 | 8/1980 | Okaka | 400/124 |
| 4,240,862 | 12/1980 | Ishiyama | 101/66 X |
| 4,381,705 | 5/1983 | Roes et al. | 101/66 X |
| 4,442,744 | 4/1984 | Raymond | 226/110 X |

*Primary Examiner*—Charles A. Pearson

*Attorney, Agent, or Firm*—Howson & Howson

[57] ABSTRACT

This theater ticket issuing machine uses a single print head to print on any selected one of three differently-colored ticket stocks. Guides establish three separate ticket stock paths, one for each color of ticket stock. These three paths converge into a common path where printing takes place. Each path has its own feed rollers driven by reversible stepping motors under micro-processor control. A cutter is located beyond the print head in the normal direction of ticket stock movement. After cutting, ticket stock is withdrawn by reverse operation of the appropriate feed rollers to clear the common path, at least where a different ticket stock is to be fed in the next issuing operation. The micro-processor can be made to eliminate the clearing step when the color of the next ticket to issue is the same as that of the last ticket issued.

9 Claims, 7 Drawing Sheets

DATA LINE
152
12
PRINTER
CUTTER SOLENOID
18
144
148
KEYBOARD
150
CUSTOMER DISPLAY
SUBSYSTEM PROCESSOR
OPERATOR DISPLAY
146
40
$M_3$
38
$M_2$
36
$M_1$
100
98
96
94
108
106
104
102

TICKET ISSUING MACHINE

BRIEF SUMMARY OF THE INVENTION

This invention relates to ticket issuing machines and more particularly to a printing ticket issuing machine adapted for use in issuing tickets for motion picture theaters, theme parks, and the like.

The most common type of motion picture ticket currently in use is a preprinted ticket supplied in rolls or fanfolds of colored ticket stock. The typical box office has at least two ticket issuing mechanisms, one for adults' tickets and one for children's tickets. Where additional categories of tickets are desired, for example tickets issued in return for promotional passes, still more issuing mechanisms are required. In multiple-screen theaters, the number of issuing mechanisms required is multiplied by the number of screens and the number of pricing categories. The trend toward multiple ticket categories and toward multiple-screen theaters, therefore, has given rise to the need for numerous issuing mechanisms, with many resulting problems such as lack of adequate space, and the need to reload ticket issuing machines at different times.

Many problems inherent in the use of preprinted ticket stock exist irrespective of the number of issuing mechanisms used in a particular theater. For example, with preprinted ticket stock, advance booking is not practical because there is no reliable way to insure that a given show will not be oversold. Preprinted tickets are frequently resold to the detriment of theater owners, through collusion between unscrupulous ticket takers and sellers. Preprinted ticket stock is also expensive, particularly because each ticket has a unique serial number.

At least some of the problems mentioned above have been recognized, but there has been no completely satisfactory solution addressing all of these problems. Printing ticket issuing machines are known, but those available heretofore have not been entirely satisfactory for use in motion picture theaters. While a single conventional printing ticket issuer can be made to print any desired information, and thus handle multiple screens and ticket categories, all tickets are printed on the same ticket stock. It is very desirable to differentiate categories of tickets, or theater screens, by color of ticket stock. A single conventional printing ticket issuer will not do this. Several machines are therefore required, one for each category of ticket, or one for each screen, each machine handling a different color of ticket stock.

The invention addresses all of the aforementioned problems through the use of a novel ticket issuing machine of the printing type in which a number of rolls or fanfolds of ticket stock having different colors or patterns are served by a single high-speed print head.

The principal object of the invention is to provide a practical printing ticket issuer suitable for use in multiple-screen motion picture theaters and wherever the differentiation of tickets by color or pattern is desirable. It is also an object of the invention to reduce the number of separate ticket issuing mechanisms needed in multiple-screen theaters and other installations having similar ticket issuing requirements. Still another object of the invention is to provide a practical ticket issuing machine which is simple, reliable and inexpensive, which improves security against ticket resale, which allows advance booking, which simplifies accounting, which operates at high speed, which takes up a minimum of space, and which operates on inexpensive ticket stock, eliminating the problems associated with the storage of preprinted ticket stock.

The invention accomplishes the above objectives through the use of a novel mechanism in which different colors of ticket stock are guided toward a single print head, and in which a control effects withdrawal of the ticket stock last printed so that, when a different ticket stock is selected, the newly selected ticket stock can approach the print head.

The ticket issuing machine in accordance with the invention comprises a ticket stock guide establishing a common ticket stock path and a plurality of separate ticket stock paths converging toward the common path. A print head is located adjacent to the common path in order to print information on ticket stock located in the common path. A cutter is also provided adjacent to the common path, for cutting tickets from the ticket stock after the ticket stock is printed.

Each of the separate ticket stock paths has feeding means associated with it, for selectably advancing ticket stock therein toward the common path and also withdrawing ticket stock away from the common path. Preferably the feeding means associated with each of the separate ticket stock paths comprises a reversible motor and a ticket stock-engaging roller driven by the motor. Withdrawal of the ticket stock is effected by reversal of the motor.

Selection means are provided to enable the operator to enter a selection of a particular ticket stock path. The selection means is preferably a keyboard or other data entry system. Preferably, it enables the operator to enter a selection calling for the automatic issuance of a number of tickets greater than one, and to enter a selection of information to be printed on the tickets. In the preferred embodiment of the invention, the selection means enables the operator to enter an entire transaction calling for the issuance of several different categories of tickets, before automatic issuance of tickets commences. Thus, the head of a family with three children can ask for "two adult and three children's tickets", be advised of the total price, and tender sufficient cash, before any of the tickets is issued.

A control means, preferably a microcomputer, is responsive to the selection means, for causing the feeding means associated with a selected ticket stock path to advance ticket stock therein into the common path and toward the print head and cutter, and causing the cutter to cut the selected ticket stock. The control means also causes the feeding means to withdraw the ticket stock from the common path, to clear the common path, after cutting and before the next advance of ticket stock into the common path from one of the separate paths different from the last selected separate path.

In the preferred form of the invention, the ticket stock is withdrawn after each cutting operation and before the next advance of ticket stock from any of the separate paths. Withdrawal occurs substantially immediately after each cutting operation and irrespective of whether or not a next selection is entered through the selection means.

It is not necessary to withdraw ticket stock fully after an issuing operation if the same ticket stock is issued in the next operation. Improvement in speed of operation can be achieved by withdrawing ticket stock only when necessary. Therefore, in an alternative embodiment, the control means causes withdrawal of the ticket stock to clear the common path only after a next selection is entered, and then only if a different ticket stock, i.e. a different separate path, is chosen.

Although the machine can be designed to cut tickets individually, the control means preferably includes detection means associated with the common path for detecting the presence or absence of ticket stock therein. The detection means is connected to provide a control signal for stopping the reverse operation of the motor when the common path is clear.

The control means also preferably causes the cutting means to withhold cutting from the time a selection is made until after the selected number of tickets passes the cutting means. Thus, where several tickets in a given category are desired by a particular customer, they are delivered as a unitary strip. This contributes to the speed of operation of the ticket issuing apparatus.

Various other objectives and advantages of the invention will appear from the following detailed description.

DETAILED DESCRIPTION

Figure 1:
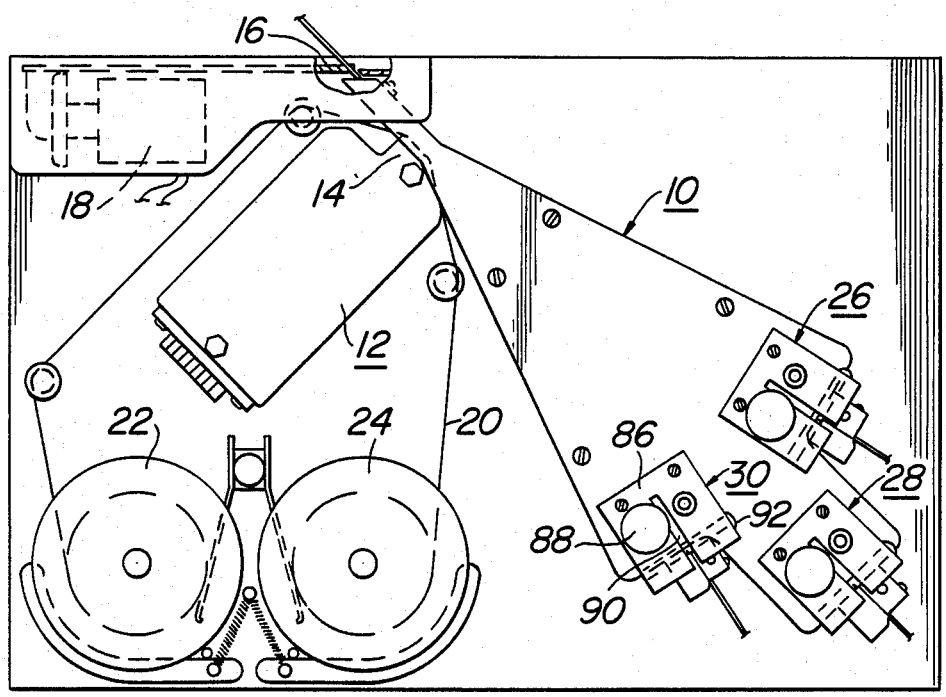
FIG. 1 is a side elevation of a ticket issuing mechanism in accordance with the invention, partially broken away to show the cutter.

The ticket issuing mechanism of FIG. 1 comprises a guide assembly 10, a printer 12 having a print head 14, a cutter comprising cutting blade 16 operated by an electrically activated solenoid 18, an inked ribbon 20 reversibly fed past print head 14 by motor-driven reels 22 and 24, and ticket stock feed assemblies 26, 28 and 30.

Printer 12 is preferably a dot column printer of the type manufactured by Baudex Corporation of Westport, Conn., U.S.A. For details of the printer, reference may be made to U.S. Pat. Nos. 4,134,691, dated Jan. 16, 1979 and 4,218,419, dated Aug. 19, 1980. The disclosures of these patents are here incorporated by reference. The printer typically comprises six modules, each corresponding to a line of print on the issued ticket. The lines of print extend in the direction of ticket movement. Each of the printer modules has a series of electromagnetically activated wires, the ribbon-engaging ends of which are aligned in the print head along a line extending transverse to the direction of ticket movement. In printing, each printed character is formed by several operations of the wire column as the ticket moves past the print head.

Figure 2:
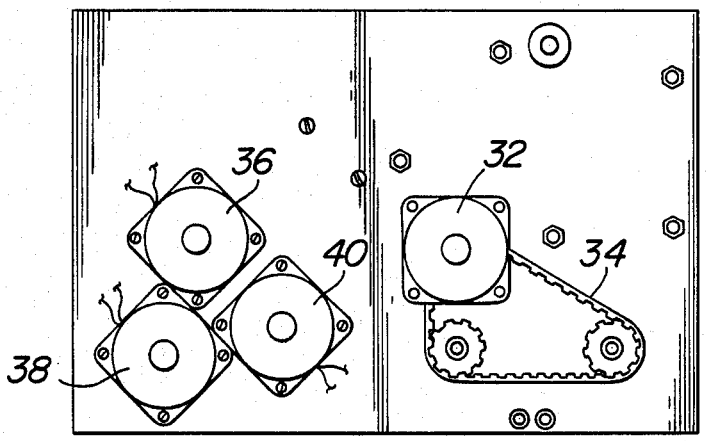
FIG. 2 is an elevational view of the opposite side of the ticket issuing mechanism.

The ink ribbon and the ticket stock feed assemblies are driven by reversible stepping motors shown in FIG. 2. Motor 32 drives the ribbon reels through flexible belt 34. Motors 36, 38 and 40 drive ticket stock feed assemblies 26, 28 and 30, respectively.

Figure 3:
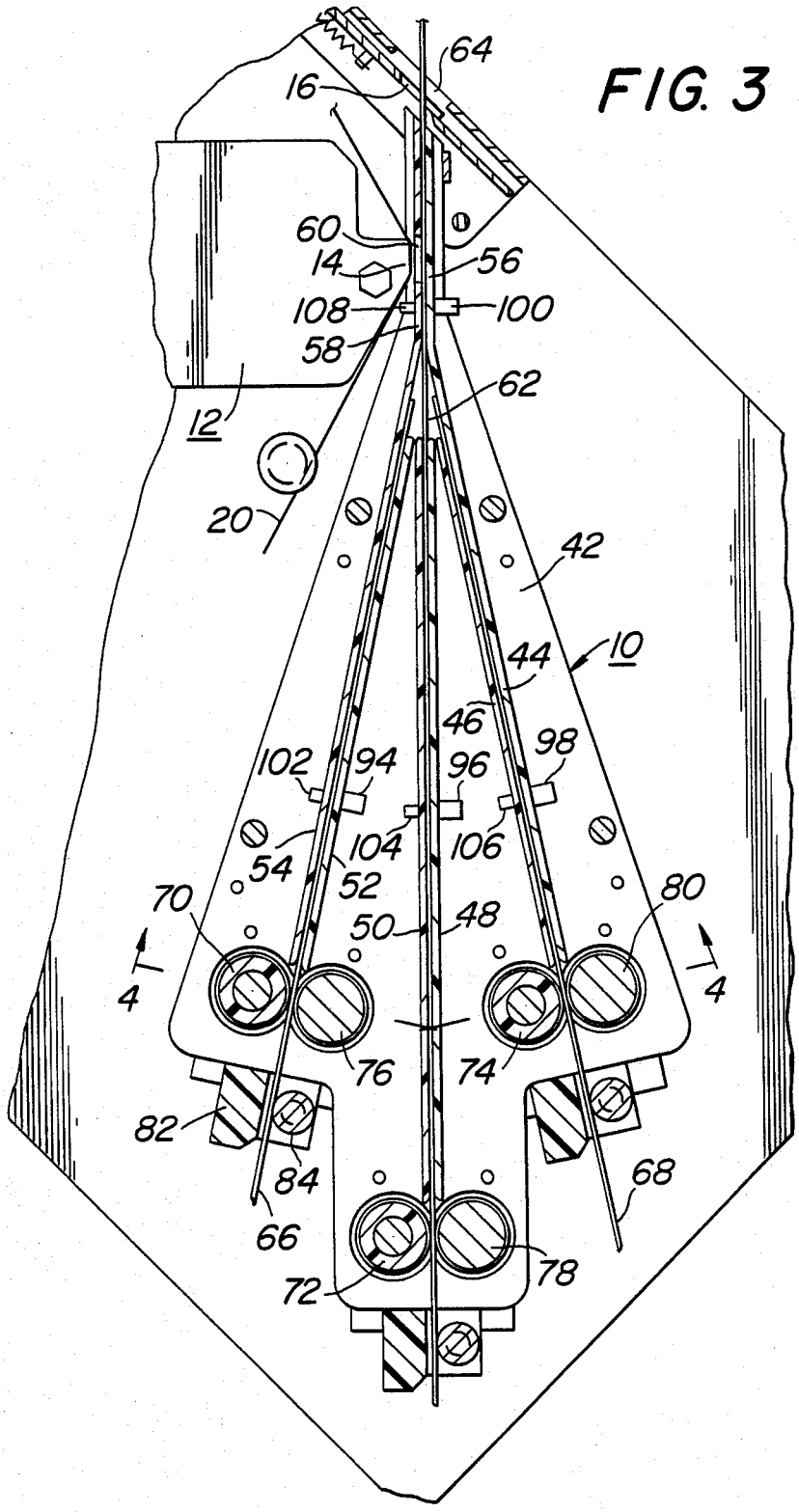
FIG. 3 is a fragmentary sectional view of the ticket issuing mechanism taken on a plane parallel to the direction of ticket stock movement and perpendicular to the faces of the ticket stock.

Ticket guide assembly 10 comprises a set of guide walls held between two generally triangular side plates. FIG. 3 shows the guide assembly with one of the side plates (the one seen in FIG. 1) removed, revealing the opposite side plate 42, and the guide walls which establish the separate ticket stock path as well as the common ticket stock path. Guide walls 44 and 46 are held in grooves in the side plates in spaced relationship to each other to provide a path for movement of ticket stock between them. Guide walls 48 and 50 are similarly held in grooves to establish a second separate ticket stock path. Guide walls 52 and 54 likewise establish a third ticket stock path. Outside guide walls 44 and 54 are extended at 56 and 58. These extensions are also held in grooves, and are spaced from each other to provide a common ticket stock path. Opening 60 in extension 58 is located adjacent to print head 14 to allow the printer to print information on the ticket in the common path. Extension 56 acts as a platen.

The guide assembly is designed so that it can be put together by first placing guide walls 52, 50, 48 and 46 in their respective grooves in plate 42, installing the opposite plate, which is also grooved to receive the guide walls, and then sliding guide walls 54 and 44 into their respective grooves, through the ends of the grooves at the end of the common path. The guide walls are preferably made of a flexible synthetic resin material. This allows walls 44 and 54 to bend, as they are installed, at the locations at which the grooves change direction. The grooves holding guide walls 48 and 50 are visible in FIG. 4.

A strip of ticket stock 62 is shown extending through the separate path between guide walls 48 and 50, and through the common path between guide walls 56 and 58, and thence past cutter blade 16, and out through opening 64 at the top of the issuing mechanism. Ticket stock 66 extends through the separate path between guide walls 52 and 54. However, it does not extend into the common path. Its end is located a short distance away from the common path. Likewise, ticket stock 68 extends through the separate path between guide walls 44 and 46, but not into the common path. So long as the common path is clear, ticket stock can be fed from any one of the separate paths into the common path, and will be guided to the common path automatically. However, if the common path is already occupied by ticket stock from one separate path, as is the case in FIG. 3, ticket stock from the other separate paths cannot enter the common path.

The ticket stock in the separate paths is driven by feeding means associated with each of the separate paths. The feeding means comprise motor-driven rollers 70, 72 and 74, and cooperating idler rollers 76, 78 and 80. As seen in FIG. 3, ticket stock 66 is pinched between drive roller 70 and idler roller 76, and the other ticket stocks are similarly pinched between drive and idler rollers. Ticket stock 66 extends between idler roller 84 and guide block 82, which are provided to facilitate threading of ticket stock toward the feeding means comprising rollers 70 and 76. The other feeding means have similar guide blocks and rollers associated with them to facilitate threading of ticket stock.

Figure 4:
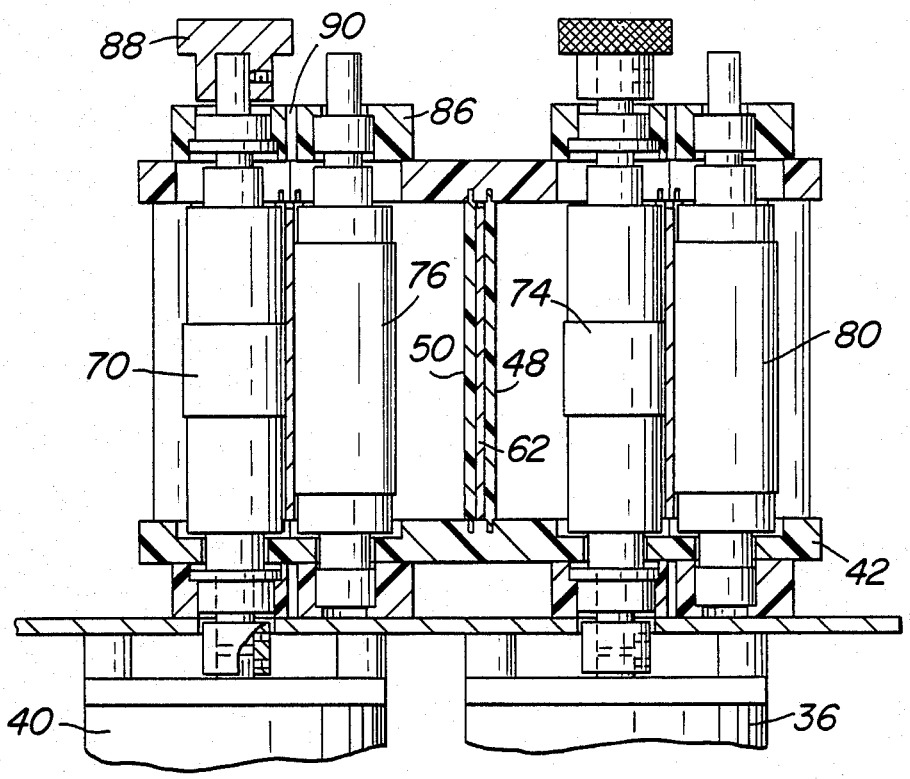
FIG. 4 is a sectional view showing the ticket stock feeding mechanism, taken on the surface 4—4 of FIG. 3.

The pressure exerted by the driven and idler rollers on the ticket stock is made adjustable by the provision of slotted bearing blocks, one of which is indicated at 86 in FIGS. 1 and 4. A bearing at one end of the driven roller is held in bearing block 86 on one side of a slot 90. The bearing at one end of the idler roller is held in the bearing block on the opposite side of slot 90. An adjusting screw 92 (FIG. 1) extends through one side of the bearing block, and is threaded into the other side. The slot makes the bearing block flexible, so that slight adjustments in the width of slot 90 can be effected by turning screw 92. This makes it possible to control the pressure exerted by the rollers on the ticket stock. A knob 88 (FIGS. 1 and 4) is secured to an extension of the shaft of driven roller 70 to permit manual rotation of the driven roller for the purpose of threading ticket stock into the guide assembly.

The bearing blocks of the other two feed assemblies are similar to those of feed assembly 30, and need not be separately described.

Photoelectric means are provided for detecting the presence and absence of ticket stock in the ticket stock paths. As shown in FIG. 3, phototransistors 94, 96 and 98 are mounted on guide walls 52, 48 and 44 respectively at intermediate locations along the separate paths. Phototransistor 100 is mounted on extension 56 of guide wall 44 at a location near print head 14 and between the print head and the transition between the separate paths and the common path. Light emitting diodes 102, 104 and 106 are mounted on guide walls 54, 50 and 46 opposite to phototransistors 94, 96 and 98. Light emitting diode 108 is mounted on guide wall extension 58, opposite phototransistor 100. The light emitting diodes and phototransistors are mounted in openings (not shown) in the guide walls and guide wall extensions so that, in the absence of ticket stock between them, light from the light emitting diodes will strike the sensitive areas of the phototransistors, while light will be blocked if ticket stock is present.

Figure 5:
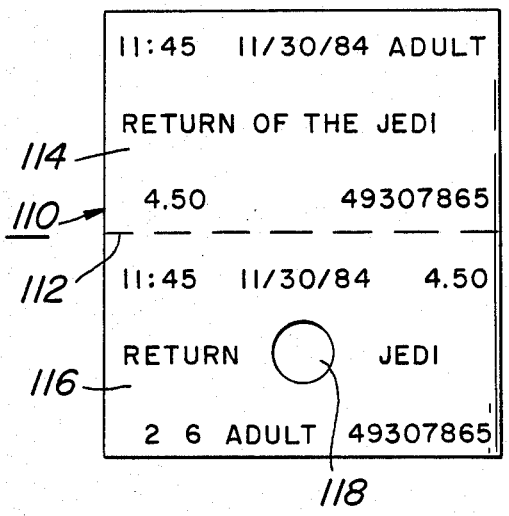
FIG. 5 is an elevational view of a typical ticket issued by the ticket issuing machine of the present invention.

Phototransistors 94, 96 and 98 provide signals indicative of the presence or absence of ticket stock in the separate paths, and disable the ticket issuing mechanism when ticket stock is exhausted in any of the separate paths. Phototransistor 100 provides a signal indicative of the presence or absence of ticket stock at the location in the common path immediately in advance of the print head. It provides a signal to the control means indicating that ticket stock is being withdrawn, and also provides a signal to the control means preventing printing unless ticket stock is present at its location. The typical ticket 110, shown in FIG. 5, has a perforation line 112, separating the ticket into a patron receipt 114, and a theater receipt 116. The theater receipt has a spindle hole 118, enabling the ticket taker to place theater receipts in order on a spindle. The spindle hole may also be read by one or more of the phototransistors for the purpose of insuring proper ticket positioning and for the purpose of counting tickets as they are issued by the machine. The patron receipt has three lines of print. The first line indicates the time and date of the show, and the class of the ticket. The second line indicates the title of the motion picture. The second line may also contain a screen number corresponding to the screen on which the particular motion picture is to be shown. The third line indicates the price and also contains a number which includes both a ticket serial number and an identifying number for the machine. If the class of ticket is indicated by the ticket stock color, the printing of the class on the ticket is redundant. However, it is desirable to print the class of ticket for the patron's information.

The first two lines of the theater receipt are substantially identical to the first two lines of the patron receipt. However, printing of the middle portion of the second line is suppressed electrically so that the print head does not attempt to print through spindle hole 118. The third line of the theater receipt contains code numbers indicating the time of the show, and the screen (in a multiple-screen theater). It also indicates the class, the ticket serial number, and the machine identification number.

Figure 6:
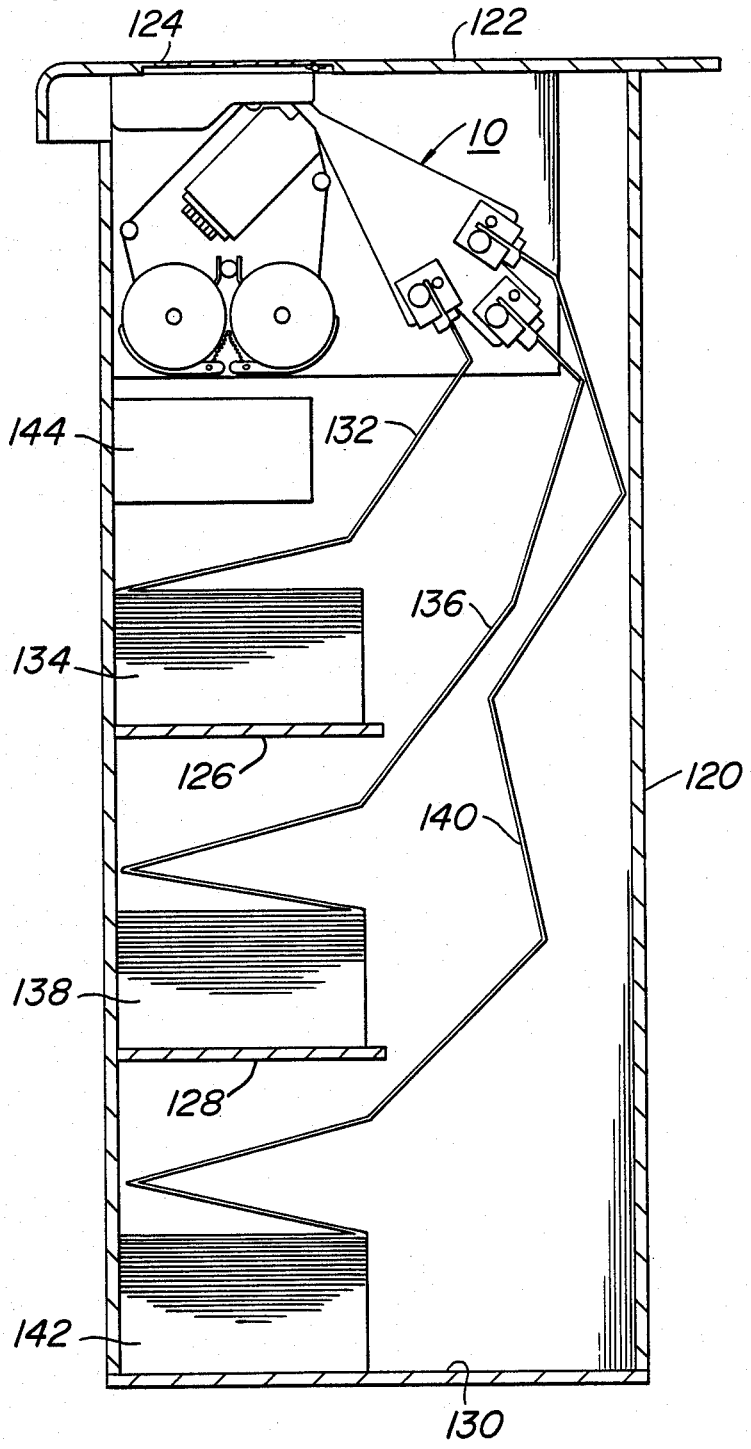
FIG. 6 is a vertical section taken through a typical cabinet containing the ticket issuing mechanism and several stacks of fanfolded ticket stock.

As shown in FIG. 6, the ticket issuing mechanism is normally housed inside a cabinet 120, along with stacks of fanfolded ticket stock. The ticket issuing mechanism is secured within the cabinet underneath the cabinet top 122. A conventional hinged door 124 is provided in top 122. This door is normally closed, and opens only when tickets are being issued.

Ticket stock 132 is fed to one of the separate paths within the guide assembly of the ticket issuing mechanism from fanfolded stack 134 on shelf 126 within the cabinet. Ticket stock 136 is fed to another separate path within the guide assembly from stack 138 on shelf 128. Ticket stock 140 is fed to still another separate path within the guide assembly from stack 142 on floor 130 of the cabinet.

Cabinet 120 also contains a subsystem processor 144, which is a conventional microprocessor, preferably programmed permanently by means of read only memories. The subsystem processor performs the control functions for the ticket issuing machine, as well as a number of other functions such as the accumulation and processing of data for display to the operator and the customer, and transmission of data over data lines to a central location. Data concerning the numbers and categories of tickets sold for each showing of a motion picture can be transmitted to, and processed by, a central computer serving a large number of ticket issuing machines. This enables a theater owner, or even the owner of a chain of theaters to obtain immediate information concerning ticket sales.

So far as this invention is concerned, the principal function of the subsystem processor is to control the operation of the ticket issuing machine itself, and especially the control of the feeding, printing and cutting means in response to selections entered through a keyboard by the ticket seller.

Figure 7:
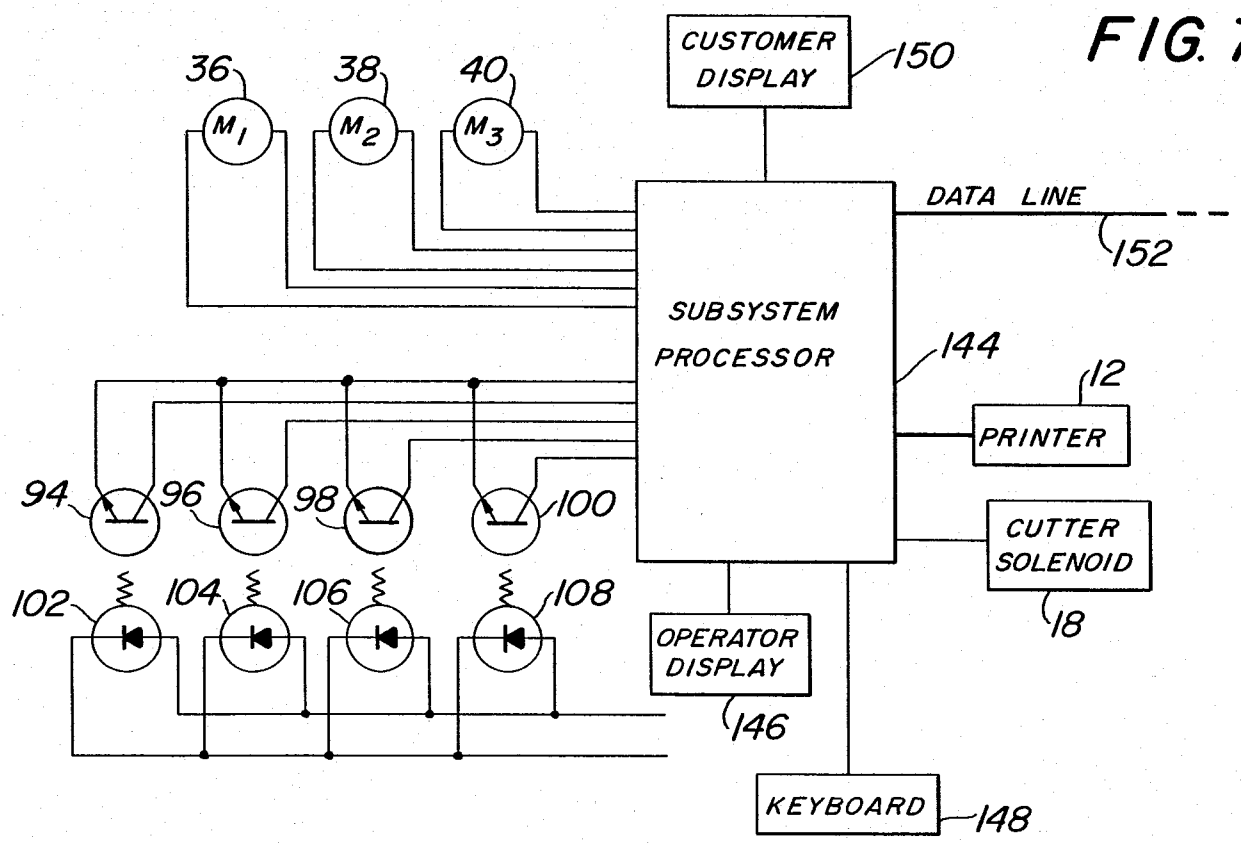
FIG. 7 is a schematic diagram of the control system for the ticket issuing machine.

Subsystem processor 144 is depicted in FIG. 7 along with a number of elements already described, which are shown diagrammatically. The subsystem processor is connected to control printer 12, cutter solenoid 18, and stepping motors 36, 38 and 40. It is also connected to receive signals from phototransistors 94, 96, 98 and 100. In addition, the subsystem processor receives signals from a keyboard 148, which serves as selection means in that it enables the operator to enter a selection of a particular ticket stock path from the three separate ticket stock paths, to enter a selection calling for the issuance of a number of tickets greater than one, and to select information to be printed on the ticket stock, for example the date and time of the show, and the title of the motion picture.

The subsystem processor is also connected to an operator display 146, and to a customer display 150. The customer's display can be an alphanumeric LED or liquid crystal display, a CRT display, or a similar device. It is visible to the customer, and is capable of displaying the quantity of tickets purchased, the classification of the tickets, the unit price of the tickets, the total amount of the transaction, the amount tendered by the customer, and the change due the customer.

Data line 152 delivers data from the subsystem processor to a central computer for accounting purposes. It can also carry signals, such as serial number resetting signals, from the central computer back to the subsystem processor. The operator's display is visible only to the operator, and displays the total price of the current transaction, the amount tendered, the change due, the quantity, classification, show time and screen for the current transaction, the date, the time, and the number of seats still available for a particular show. The operator's display should also be capable of displaying information concerning an immediately previous transaction. In addition, it should be capable of displaying information concerning the status of the system, including malfunctions of the ticket issuing mechanism, approaching exhaustion of ticket stock, approaching full theater sales, etc. An ascending housecount, a descending housecount, or both may be displayed. Preferably, the operator display provides prompting to assist the ticket seller in entering data properly. All of the foregoing functions, as well as the ticket issuing control functions of the subsystem processor can be achieved by appropriate programming of the processor in a manner known to persons skilled in microprocessor programming.

Figure 8:
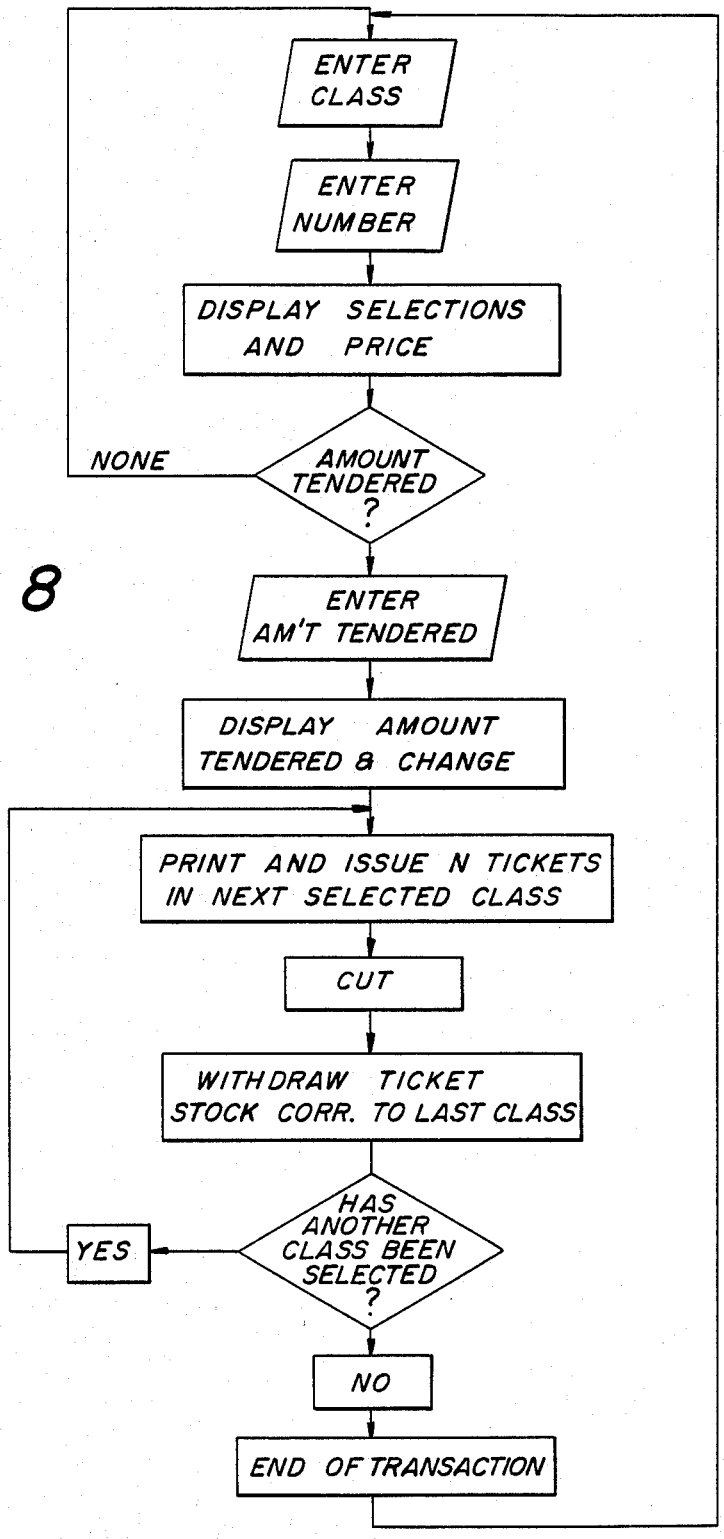
FIG. 8 is a flow chart illustrating the operation of a preferred control system.

FIG. 8 is a simplified flow chart illustrating the manner in which the ticket issuing mechanism is controlled by the subsystem processor. Most of the extraneous functions of the processor have been eliminated in the chart. In the first step of the flow chart, the processor calls for the entry of a class of ticket, e.g. "adult", "child" or "pass". ("Pass" is a class of ticket issued to a customer who presents a pass issued by a business or other organization with which the theater has a promotional agreement.) The several classes correspond to different colors of ticket stock. The processor calls for the entry of the class by an appropriate signal on the operator's display.

The processor then calls for the entry of the number of tickets in the particular class just selected.

The selection and price are shown both on the customer's display and on the operator's display. The total amount of the transaction is displayed, and is updated in the event that the customer desires tickets in more than one class. Unless the customer tenders money, and the amount tendered is entered by the operator, it is possible to enter a new class and a new number of tickets for that class, in which event, all selections and prices, the total amount for each class, and an updated total amount for the transaction will be displayed.

If money is tendered by the customer, and the amount tendered is entered by the operator, the amount tendered will be displayed along with the amount of change due the customer. The amount of change is calculated within the subsystem processor.

Immediately, the subsystem processor directs the ticket issuing mechanism to print and issue the first selected number of tickets in the first selected class. Ticket stock is fed forwardly by the motor-driven roller in the separate path corresponding to the selected class. If the number of tickets in the first selected class is one, a single ticket is simultaneously printed and fed, and then cut and delivered to the customer. If the number of tickets selected is greater than one, the tickets in the particular selected class are simultaneously printed and fed, and then delivered as a unitary strip. The cutter operates only once for each class in any given transaction. The subsystem processor is programmed to withhold a signal directing the cutter solenoid to operate until all of the tickets in the strip have been printed and issued. After cutting takes place, the subsystem processor directs the same feed mechanism which just moved ticket stock in the forward direction to operate in reverse and thereby move its ticket stock rearwardly until the common path within the guide assembly is clear. Phototransistor 100 sends a signal to the subsystem processor indicating that ticket stock has been partially withdrawn. After receiving the signal from phototransistor 100 indicating that withdrawal is in progress, the subsystem processor delivers a predetermined number of pulses to the stepping motor of the selected feed mechanism, to complete withdrawal of the ticket stock to the point at which the common path is clear. After withdrawal of the ticket stock, the subsystem processor determines whether or not another class had been selected in the current transaction. If another class had been selected, another printing and issuing operation takes place, followed by cutting and withdrawal of ticket stock. This process continues until all the selected classes have been exhausted. At the end of the transaction, the system is ready for a new transaction, and the operator display calls for the entry of a class.

Figure 9:
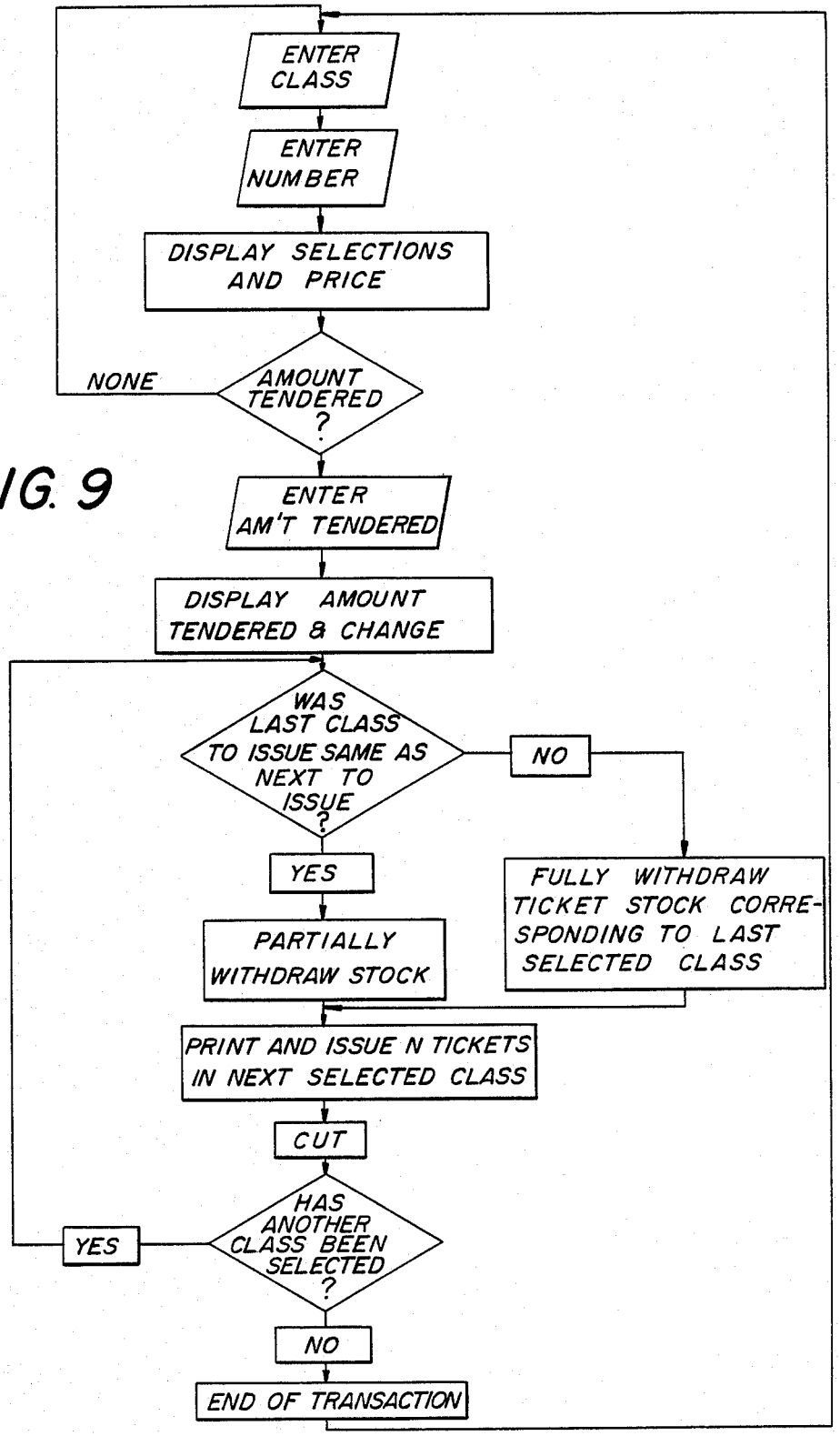
FIG. 9 is a flow chart illustrating the operation of an alternative control system.

The flow chart in FIG. 9 pertains to an alternative embodiment which is substantially identical to the embodiment just described except that the subsystem processor is programmed to cause withdrawal of ticket stock to clear the common path only when there is a change in the ticket stock to be issued.

Assuming that different ticket stocks in the machine correspond to different classes of tickets, i.e. "adult", "child", and "pass", and that in a series of transactions, only adult tickets are called for, the ticket path need not be cleared. Ticket stock is withdrawn from the cutting blade immediately when each printing operation commences, but only to the extent of the distance between the cutting blade and the print head, to insure that printing begins near the leading edge of the ticket stock.

From the beginning of the operation, through the box labelled "display amount tendered and change", the flow chart in FIG. 9 is identical to that in FIG. 8. Following the display of the amount tendered and change, the subsystem processor determines whether or not the last class issued was the same as the next class to issue. If the answer is "yes", the ticket issuing mechanism is directed withdraw ticket stock partially to eliminate the leading edge margin and then to print and issue the selected number of tickets in the selected class. If the answer is "no", the ticket stock corresponding to the last class to issue is fully withdrawn to clear the common path, and printing and issuance of tickets proceeds. Cutting takes place after the printing and issuing step. Thereafter, the processor determines whether or not another class has been selected in the transaction. If another class has been selected, the operation returns to the point at which the processor determines whether or not the last class issued is the same as the next to issue. If, on the other hand, no other class has been selected in the transaction, the transaction is ended, and the machine calls for the entry of a new transaction, commencing with the entry of the class.

In the operation depicted in FIG. 9, the feeding means fully withdraws the ticket stock from the common path to clear the common path only after a next selection is entered, and then only if the separate path chosen in the next selection is different from the separate path chosen in the selection made immediately prior to said next selection.

The processor remembers the class of tickets last issued in each transaction, and in the first issuance step of the next transaction, stock is fully withdrawn only if the ticket stock to be issued is different from the ticket stock issued at the end of the last transaction. This mode of operation enhances speed of ticket issuance, particularly in those instances where the particular motion picture being shown is viewed only or primarily by one class of patron. In that event, there is no need to clear the common path except in those rare instances where a different class of ticket is desired. The machine is nevertheless capable of operation in mixed-class situations, e.g. motion pictures which are viewed by children accompanied by adults.

The ticket issuing machine in accordance with the invention has numerous advantages over earlier ticket issuing machines. In particular it efficiently handles several different colors of ticket stock and reduces the number of separate ticket issuing mechanisms needed in a theater. The reduction of the number of machines is especially significant in multiple-screen theaters, where there may otherwise be insufficient space for the requisite number of ticket issuing machines. The machine provides the advantages of different colored ticket stocks for different classes of customers (or alternatively for different screens) in a simple, reliable and inexpensive ticket issuing mechanism. Because the machine prints tickets instead of issuing preprinted tickets, less expensive ticket stock can be used, and better security can be achieved. Printing and microprocessor control also allow advance booking. A customer can purchase tickets days or even weeks in advance, and the microcomputer can keep track of all tickets sold for each show to insure against overbooking. Transmission of data to a central location simplifies accounting, which can be carried out on a central computer.

Various modifications can be made to the apparatus described. For example, while the ticket issuing machine described above have provisions for three ticket stock paths, they could be made to accommodate two ticket stock paths, or four or more ticket stock paths, if appropriate. The different ticket stocks, instead of corresponding to different classes of tickets, can correspond to different theater screens, in which event the classes would be indicated by printed information on the tickets. A modification to accommodate a number of ticket stocks corresponding to the number of screens would be made in this instance. In addition to mechanical modifications to the ticket issuing mechanism, programming modifications would be made in the subsystem processor to cause the machine to issue tickets from different ticket stock, depending on the theater screen selected.

It is also possible to interconnect several ticket issuing mechanisms with a single subsystem processor. The subsystem processor would be programmed to control and accept data from the several issuing mechanisms. A single data entry keyboard, along with a single operator's display and a single customer display can therefore be associated with several ticket issuing mechanisms.

Instead of storing ticket stock in stacks within the ticket issuing machine, ticket stock can be stored in roll form. Furthermore, the machine can be modified for sprocket feeding instead of frictional feeding, if desired. The photoelectric detectors can be eliminated. Instead of relying on the photoelectric detection means in the common path to provide a signal to the processor indicating that ticket stock withdrawal is taking place, the system can be made "open-loop", by allowing the system to assume that, if a given number of pulses have been delivered to the selected motor to effect withdrawal, withdrawal has in fact taken place. If the system corresponds to the flow chart in FIG. 8, a modification can be made so that withdrawal of ticket stock and clearing of the common path takes place at the beginning, rather than at the end of a ticket issuing operation.

Finally, in operation according to the flow chart of FIG. 9, the print head and cutter can be brought into such close proximity with each other that the short reverse movement of the ticket stock prior to printing in order to eliminate margins is unnecessary.

Various other modifications can be made to the apparatus described without departing from the scope of the invention as defined in the following claims.

I claim:

1. A ticket issuing machine comprising:

guide means establishing a common ticket stock path having a ticket stock receiving end and a ticket stock delivery end and a plurality of separate ticket stock paths converging toward said receiving end of said common path;

printing means, located adjacent to said common path for printing information on ticket stock in said common path at a printing location between the receiving end and the delivery end thereof;

cutting means, located adjacent to the delivery end of said common path, and beyond said printing location in the direction of ticket stock movement from the receiving end of the common path toward the delivery end thereof, for cutting tickets from said ticket stock after said ticket stock is printed by said printing means;

feeding means associated with each of said separate ticket stock paths, for selectably advancing ticket stock therein toward said common path and also withdrawing ticket stock away from said common path in the direction from the delivery end thereof toward the receiving end thereof;

selection means for enabling an operator to enter a selection of a particular ticket stock path from said plurality of separate ticket stock paths; and control means, automatically responsive to the selection means, for causing the feeding means associated with a selected path to advance ticket stock therein into and through said common path past the printing means during printing and past the cutting means, for causing the cutting means to cut the selected ticket stock, and for causing the feeding means to withdraw the selected ticket stock from the common path into the selected path, to clear the common path, after cutting and before the next advance of ticket stock into said common path from one of said separate paths different from the last selected separate path.

2. A ticket issuing machine according to claim 1 in which the control means causes the feeding means to withdraw the ticket stock from the common path into the selected path, to clear the common path, after each cutting operation and before the next advance of ticket stock into said common path from any one of said separate paths.

3. A ticket issuing machine according to claim 1 in which the control means causes the feeding means to withdraw the ticket stock from the common path into the selected path, to clear the common path, substantially immediately after each cutting operation irrespective of whether or not a next selection is entered through said selection means.

4. A ticket issuing machine according to claim 1 in which the control means causes the feeding means to withdraw the ticket stock from the common path into the selected path, to clear the common path, only after a next selection is entered through said selection means and only if the separate path chosen in said next selection is different from the separate path chosen in the selection made immediately prior to said next selection.

5. A ticket issuing machine according to claim 1 in which the feeding means associated with each of said separate ticket stock paths comprises a reversible motor and a ticket stock-engaging roller driven by said motor.

6. A ticket issuing machine according to claim 1 in which the feeding means associated with each of said separate ticket stock paths comprises a reversible motor and a ticket stock-engaging roller driven by said motor, and in which the control means includes means for causing reversal of the motor for withdrawal of the ticket stock.

7. A ticket issuing machine according to claim 1 in which the feeding means associated with each of said separate ticket stock paths comprises a reversible motor and a ticket stock-engaging roller driven by said motor, and in which the control means includes means for causing reversal of the motor for withdrawal of the ticket stock, and detection means associated with the common path for detecting the presence or absence of ticket stock therein, said detection means being connected to provide a control signal for stopping the reverse operation of the motor when the common path is clear.

8. A ticket issuing machine according to claim 1 in which the selection means enables an operator to enter a selection calling for the issuance of a number of tickets greater than one from the ticket stock passing through any one of said separate ticket stock paths, and in which the control means causes the cutting means to withhold cutting from the time the selection is made until after said number of tickets passes the cutting means and thereafter to cut the ticket stock to deliver the selected number of tickets as a unitary strip.

9. A ticket issuing machine according to claim 1 in which the selection means also enables the operator to select information to be printed on the ticket stock by the printing means.

* * * * *